US007683870B2

(12) United States Patent
Kang et al.

(10) Patent No.: US 7,683,870 B2
(45) Date of Patent: Mar. 23, 2010

(54) LIQUID CRYSTAL DISPLAY DEVICE WITH A PRE-CHARGING CIRCUIT

(75) Inventors: Sin Ho Kang, Suwon-shi (KR); Jin Cheol Hong, Kumi-shi (KR); Sung Chul Ha, Gyeongsangbuk-do (KR)

(73) Assignee: LG. Display Co., Ltd., Seoul (KR)

( * ) Notice: Subject to any disclaimer, the term of this patent is extended or adjusted under 35 U.S.C. 154(b) by 1105 days.

(21) Appl. No.: 11/320,252

(22) Filed: Dec. 27, 2005

(65) Prior Publication Data

US 2006/0290638 A1 Dec. 28, 2006

(30) Foreign Application Priority Data

Jun. 28, 2005 (KR) ..... 10-2005-0056543

(51) Int. Cl.
*G09G 3/36* (2006.01)

(52) U.S. Cl. ..... 345/89; 345/98

(58) Field of Classification Search ..... 345/87, 345/89, 95, 96, 98, 100; 365/189.05
See application file for complete search history.

(56) References Cited

U.S. PATENT DOCUMENTS 5,600,345 A * 2/1997 Dingwall et al. ..... 345/100
6,538,647 B1 * 3/2003 Chen et al. ..... 345/211
7,068,292 B2 * 6/2006 Morita ..... 345/690
2002/0011979 A1 * 1/2002 Nitta et al. ..... 345/89
2004/0095306 A1 * 5/2004 Fujiyoshi ..... 345/94

FOREIGN PATENT DOCUMENTS

CN 1372241 10/2002
JP 04-067195 3/1992

OTHER PUBLICATIONS

First Office Action for corresponding Chinese Patent Application Serial No. 2005100230521, dated Nov. 23, 2008.

* cited by examiner

*Primary Examiner*—Chanh Nguyen
*Assistant Examiner*—Ram A Mistry
(74) *Attorney, Agent, or Firm*—Brinks Hofer Gilson & Lione

(57) ABSTRACT

A liquid crystal display device is set forth that comprises a data line that is connected to drive a liquid crystal cell and an output driver connected to selectively provide a pixel drive signal to the data line. The pixel drive signal corresponds to a digital video data signal provided to the liquid crystal display device. A pre-charging circuit is used to reduce the power consumed by the output driver. To this end, the pre-charging circuit is connected to selectively pre-charge the data line to one or more of a plurality of voltage levels depending on the value of the digital video data signal. In one embodiment, the plurality of voltage levels comprises a positive pre-charge voltage, a negative pre-charge voltage, and a charge share voltage. The magnitudes of the positive pre-charge voltage and the negative pre-charge voltage may be chosen so that they are greater than the magnitude of the charge share voltage.

15 Claims, 13 Drawing Sheets

---- CHARGE SHARING

OUTPUT BUFFER DRIVING AREA OF DATA IC

DMUX TRUTH TABLE

| Input | | Out put | | | |
|---|---|---|---|---|---|
| S1 | S0 | M0 | M1 | M2 | M3 |
| 0 | 0 | 1 | 0 | 0 | 0 |
| 0 | 1 | 0 | 1 | 0 | 0 |
| 1 | 0 | 0 | 0 | 1 | 0 |
| 1 | 1 | 0 | 0 | 0 | 1 |

DMUX TRUTH TABLE

| D7 ($2^7$) | D6 ($2^6$) | D5 ($2^5$) | S1 |
|---|---|---|---|
| 1 | 1 | 1 | 1 |
| 1 | 1 | 0 | 1 |
| 1 | 0 | 1 | 1 |
| 1 | 0 | 0 | 0 |
| 0 | 1 | 1 | 0 |
| 0 | 1 | 0 | 0 |
| 0 | 0 | 1 | 0 |
| 0 | 0 | 0 | 0 |

S1 IS HIGH LOGIC LEVEL WHEN GRAY IS 160 OR MORE

DMUX TRUTH TABLE

| D7 ($2^7$) | D6 ($2^6$) | S1 |
|---|---|---|
| 0 | 0 | 0 |
| 0 | 1 | 0 |
| 1 | 0 | 0 |
| 1 | 1 | 1 |

S1 IS HIGH LOGIC LEVEL WHEN GRAY IS 192 OR MORE

DMUX TRUTH TABLE

| D7 ($2^7$) | D6 ($2^6$) | D5 ($2^5$) | S1 |
|---|---|---|---|
| 1 | 1 | 1 | 1 |
| 1 | 1 | 0 | 0 |
| 1 | 0 | 1 | 0 |
| 1 | 0 | 0 | 0 |
| 0 | 1 | 1 | 0 |
| 0 | 1 | 0 | 0 |
| 0 | 0 | 1 | 0 |
| 0 | 0 | 0 | 0 |

S1 IS HIGH LOGIC LEVEL WHEN GRAY IS 224 OR MORE

LIQUID CRYSTAL DISPLAY DEVICE WITH A PRE-CHARGING CIRCUIT

This application claims the benefit of Korean Patent Application No. P 2005-56543 filed on Jun. 28, 2005, which is hereby incorporated by reference.

BACKGROUND OF THE INVENTION

1. Field of the Invention

The present invention relates to a liquid crystal display device. More particularly, the present invention relates to a liquid crystal display device having a device driver with low power consumption and low heat generation. The present invention also includes a method for driving the liquid crystal display device with the device driver.

2. Description of the Related Art

A liquid crystal display device controls light transmittance through individual liquid crystal cells. The transmittance through each individual liquid crystal cell is controlled in accordance with a corresponding video signal. The video signals control the light transmittance through the liquid crystal cells to display a picture.

There are several liquid crystal display types. One such display type known as an active matrix liquid crystal display device allows rapid switching of the transmittance states through each individual crystal cell. Accordingly, active-matrix devices are frequently used to display pictures that rapidly change over time, such as motion pictures. Rapid switching of the liquid crystal cells in an active matrix display device is achieved using a thin film transistor (hereinafter, referred to as "TFT") as a switching device.

A schematic block diagram of one example of a liquid crystal display device and corresponding driver of the related art is shown in FIG. 1. The liquid crystal display device includes a liquid crystal display panel 2 where a plurality of data lines 5 and a plurality of gate lines 6 cross each other. A plurality of TFT's are respectively formed for driving liquid crystal cells in the areas where each data line crosses a corresponding gate line. A data driver 3 is used to provide data to the data lines 5, and a gate driver 4 is used to provide a scan pulse to the gate lines 6. A timing controller 1 is used to generate the various signals that are used to control and/or operate the data driver 3 and the gate driver 4.

The liquid crystal display panel 2 has a liquid crystal injected between an upper and lower glass substrate. The data lines 5 and the gate lines 6 are formed perpendicular to one another on the lower glass substrate. A TFT is formed where each data line 5 and gate line 6 cross one another. At this junction, the gate electrode of the TFT is connected to a corresponding gate line 6 and the source electrode of the TFT is connected to a corresponding data line 5. The drain electrode of the TFT is connected to a pixel electrode of the liquid crystal cell. Further, a storage capacitor is formed on the lower glass substrate of the liquid crystal display panel 2 for sustaining the voltage of the liquid crystal cell at various voltage levels to which it has been charged.

The timing controller 1 employs a number of different signals to carry out its various functions. For example, it receives digital video data RGB from, for example, an external source, and provides it to the data driver 3. Other signals that may be provided to the timing controller 1 or generated by it include a horizontal synchronization signal H, a vertical synchronization signal V and a clock signal CLK. In the illustrated example, the timing controller 1 generates a gate driver control signal GDC for provision to the gate driver 4 and a data driver control signal DDC for provision to the data driver 3. The data driver control signal DDC may be comprised of a number of different signals such as, for example, a source shift clock SSC, a source start pulse SSP, a polarity control signal POL, a source output enable signal SOE. The gate control signal GDC may be comprised of a number of different signals such as, for example, of a gate start pulse GSP, a gate shift clock GSC, a gate output enable signal GOE.

As noted above, the gate driver 4 may be in the form of a shift register that sequentially generates the scan pulse. For example, the gate driver sequentially generates the scan pulse in response to the state of the gate control signal GDC received from the timing controller 1. The gate driver 4 may also include a level shifter for shifting the voltage of the scan pulse to a level which is suitable for driving the liquid crystal cell. Finally, the gate driver 4 may also include an output buffer. The gate driver 4 supplies the scan pulse sequentially to each gate line 6, thereby turning on the corresponding TFT's connected to the respective gate line 6. This results in the selection of one horizontal row of liquid crystal cells to which a pixel drive voltage corresponding to the RGB data, i.e., an analog gamma compensation voltage, is supplied. The pixel voltages for the individual liquid crystal cells of the row of the active gate line 6 are provided by the data driver 3 to the respective liquid crystal cells.

The data driver 3 supplies the data to the data lines 5 in response to the data drive control signal DDC supplied from the timing controller 1. The data driver 3 samples the digital data RGB from the timing controller 1, latches the data, and then converts the data to, for example, an analog gamma voltage for use in as the pixel drive voltage. The data driver 3 may be implemented as one or more monolithic integrated circuits (hereinafter, referred to as "IC") 3A having the configuration shown in FIG. 2. To this end, all of the components of the IC 3A may be implemented on a single monolithic integrated circuit or as separate integrated circuits.

Each of the data ICs 3A, as shown in FIG. 2, include a data register 21 that receives the digital video data RGB from the timing controller 1. Each of the data ICs 3A also comprises a shift register 22 for generating a sampling clock; a first latch 23, a second latch 24, a digital/analog converter (hereinafter, referred to as "DAC") 25 and an output circuit 26. Output circuit 26 includes a plurality of data lines DL1 to DLk. Further components used in or by the IC 3A include a gamma voltage supplier 27 connected between a gamma reference voltage generator (not shown) and the DAC 25. The gamma reference voltage generator provides stable upper and lower gamma voltage references, GH and GL, respectively, to the gamma voltage supplier 27.

The data register 21 supplies the digital video data RGB from the timing controller 1 to the first latch 23. The shift register 22 shifts the source start pulse SSP from the timing controller 1 in accordance with the source sampling clock SSC to generate a sampling signal. Further, the shift register 22 shifts the source start pulse SSP to transmit a carry signal CAR to the shift register 22 of the next stage. The first latch 23 sequentially samples the digital data RGB from the data register 21 in response to the sampling signal received from the shift register 22. The second latch 24 latches the data received from the first latch 23, and then concurrently outputs the latched data in response to the state of the source output enable signal SOE received from the timing controller 1. The DAC 25 converts the digital video data that it receives from the second latch 24 into gamma voltages based on the voltages DGH, DGL that it receives from the gamma voltage suppler 27. The gamma voltages provided at the outputs of the DAC 25 are analog voltages corresponding to the gray levels of the digital video data RGB. The output circuit 26 receives the gamma voltages from the DAC 25 and provides them to the input of the output circuit 26. The output circuit 26, in turn, is connected to provide an analog driving signal to each of the data lines 5. The gamma voltage supplier 27 subdivides the range of gamma reference voltages, GH and GL provided from the gamma reference voltage generator to supply the gamma voltages corresponding to each gray level to the DAC 25.

As the size and visual requirements of such liquid crystal displays have increased, the load, frequency of operation, and the amount of heat generated by data IC 3A have likewise increased. The generation of excess heat by the data IC 3A, has been a factor in decreasing the driving reliability of the data IC 3A. A major cause of heat generation in the data IC 3A is the amount of current that must flow through the output buffers of the output circuit 26. An exemplary output buffer is shown at 26A of FIG. 3. As illustrated, the data IC 3A consumes power as it acts as a current Isource, and a current sink, Isink. The Isource and Isink currents flow through resistive components of the output buffer 26A resulting in the generation of excess heat.

Recently, several methods for driving the liquid crystal cells of a liquid crystal display have been developed to improve the charging characteristics of the liquid crystal cell. One such method is known as the charge share method. In accordance with the charge share method, a given data line is driven to a single shared voltage level VShare in the time between successive outputs of the actual data voltage levels on the given data line. One example of the output signals provided to a data line using the charge share method is shown in FIG. 4. As can be seen in this figure, a substantial amount of current flows through the output buffer 26A in an output buffer driving section as the voltage on the data line transitions from the shared voltage VShare to the data voltage. As a result of this flow of current during these transitions, heat generation and the power consumption are substantial.

Another method for driving the liquid crystal cells of a liquid crystal display is known as the pre-charge method. In accordance with this method, a given data line is alternately driven to one of two voltage levels, +Vpre or −Vpre, between successive outputs of the actual pixel drive signals on the same data line. One example of the output signals provided to a data line using the pre-charge method is shown in FIG. 5. As can be seen in this figure, the voltage transitions experienced by the output buffer 26A have been somewhat reduced through the use of the pre-charge voltages +Vpre, −Vpre. But, the temperature of the data IC 3A is increased and the power consumption is rapidly increased in the pre-charge driving area 51, 52 of the low data voltage due to the pre-charge voltage +Vpre, −Vpre supplied from the outside, where it is high, in the data voltage which is a mean or less. Therefore, further performance improvement of the pre-charge method is needed.

SUMMARY OF THE INVENTION

A liquid crystal display device is set forth that comprises a data line that is connected to drive a liquid crystal cell and an output driver connected to selectively provide a pixel drive signal to the data line. The pixel drive signal corresponds to a digital video data signal provided to the liquid crystal display device. A pre-charging circuit is used to reduce the power consumed by the output driver. To this end, the pre-charging circuit is connected to selectively pre-charge the data line to one or more of a plurality of voltage levels depending on the value of the digital video data signal. In one embodiment, the plurality of voltage levels comprises a positive pre-charge voltage, a negative pre-charge voltage, and a charge share voltage. The magnitudes of the positive pre-charge voltage and the negative pre-charge voltage may be chosen so that they are greater than the magnitude of the charge share voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 6:
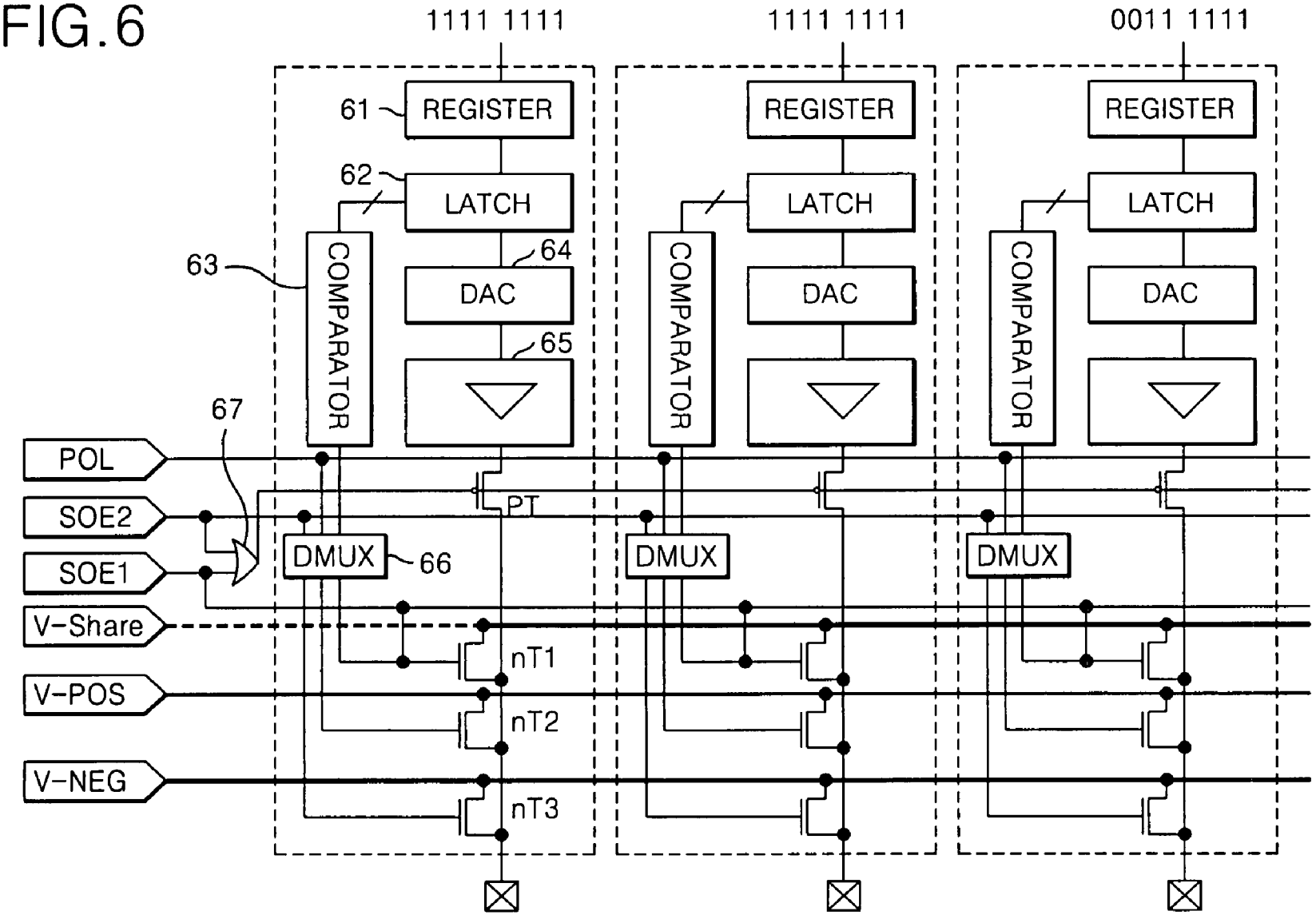
FIG. 6 is a schematic block diagram of one embodiment of an analog sampling device that may be used in a system of the type shown in FIG. 1.
Figure 7:
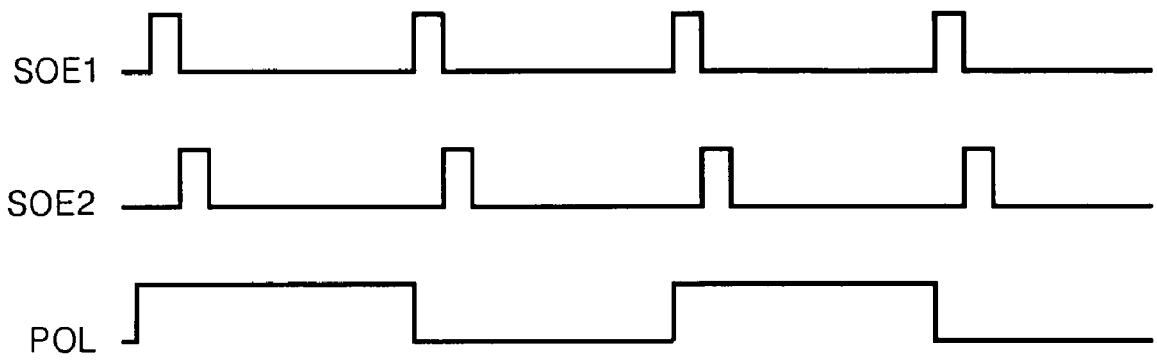
FIG. 7 is a signal timing diagram representing the source output enable signals and the polarity control signal shown in FIG. 6.

FIG. 6 is a schematic block diagram showing an exemplary configuration that may be used to construct a data IC of a liquid crystal display device. FIG. 7, in turn, is a timing signal diagram showing the waveforms for the source output enable signals SOE1, SOE2 and the polarity control signal POL used in the system shown in FIG. 6.

Figure 1:
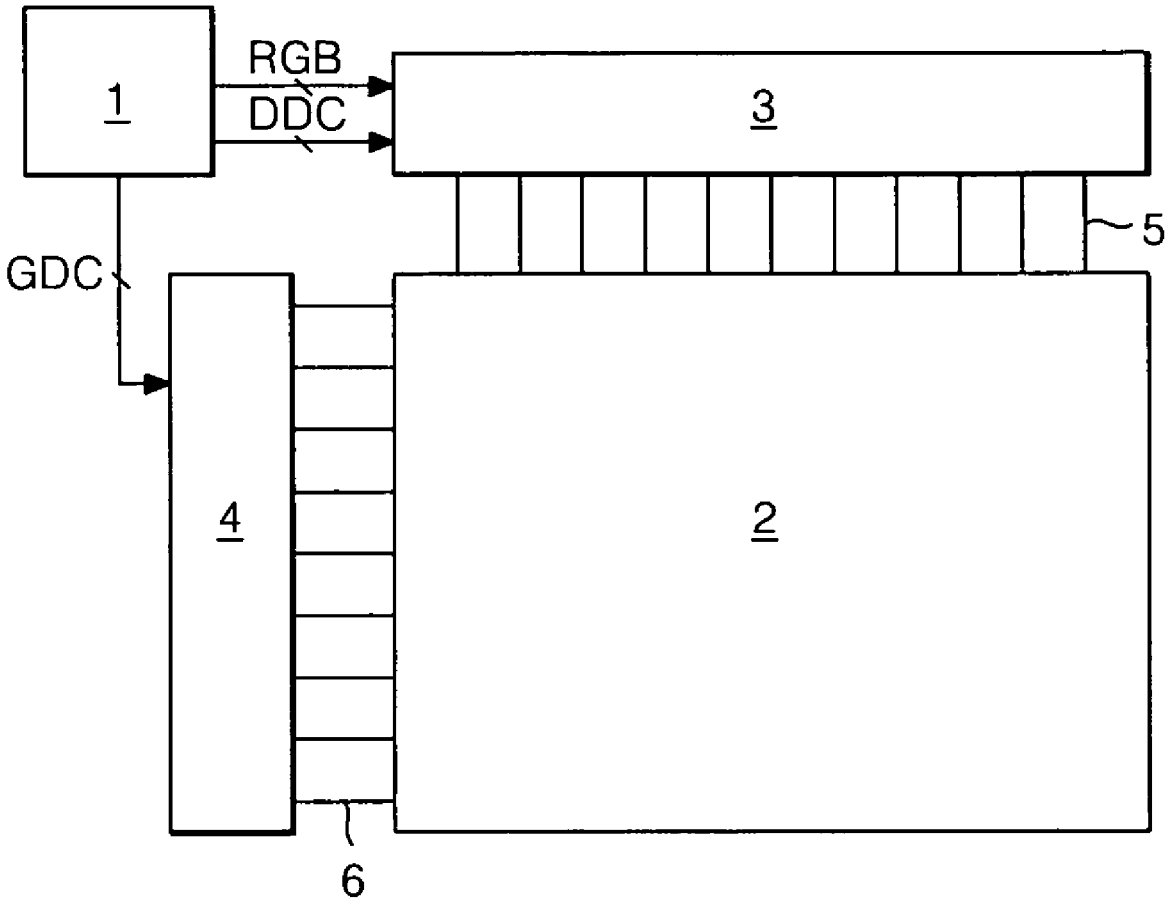
FIG. 1 RELATED ART
FIG. 1 is a schematic block diagram representing one embodiment of a liquid crystal display device.
Figure 2:
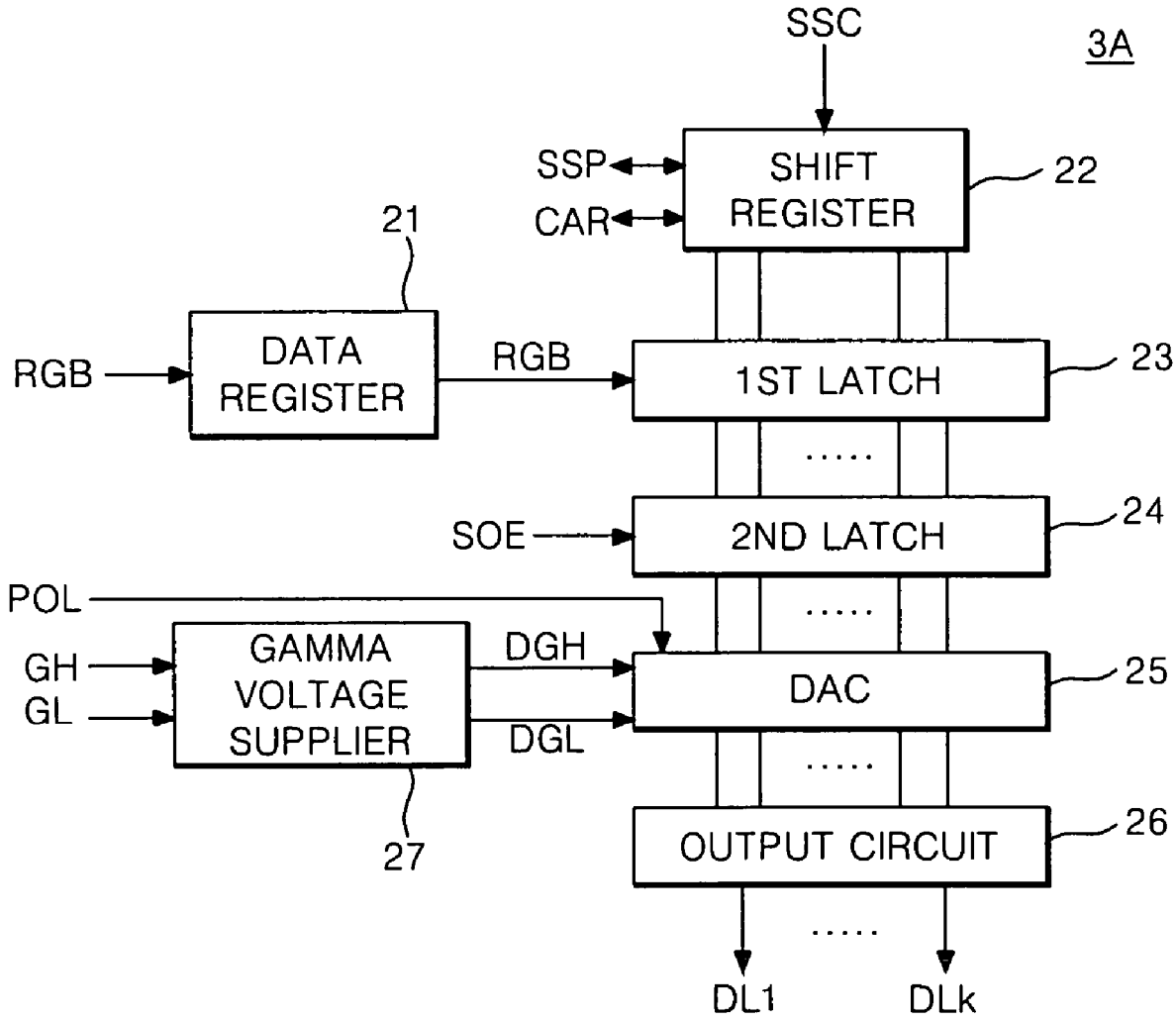
FIG. 2 RELATED ART
FIG. 2 is a schematic block diagram representing one embodiment of a data driver suitable for use in the system shown in FIG. 1.
Figure 3:
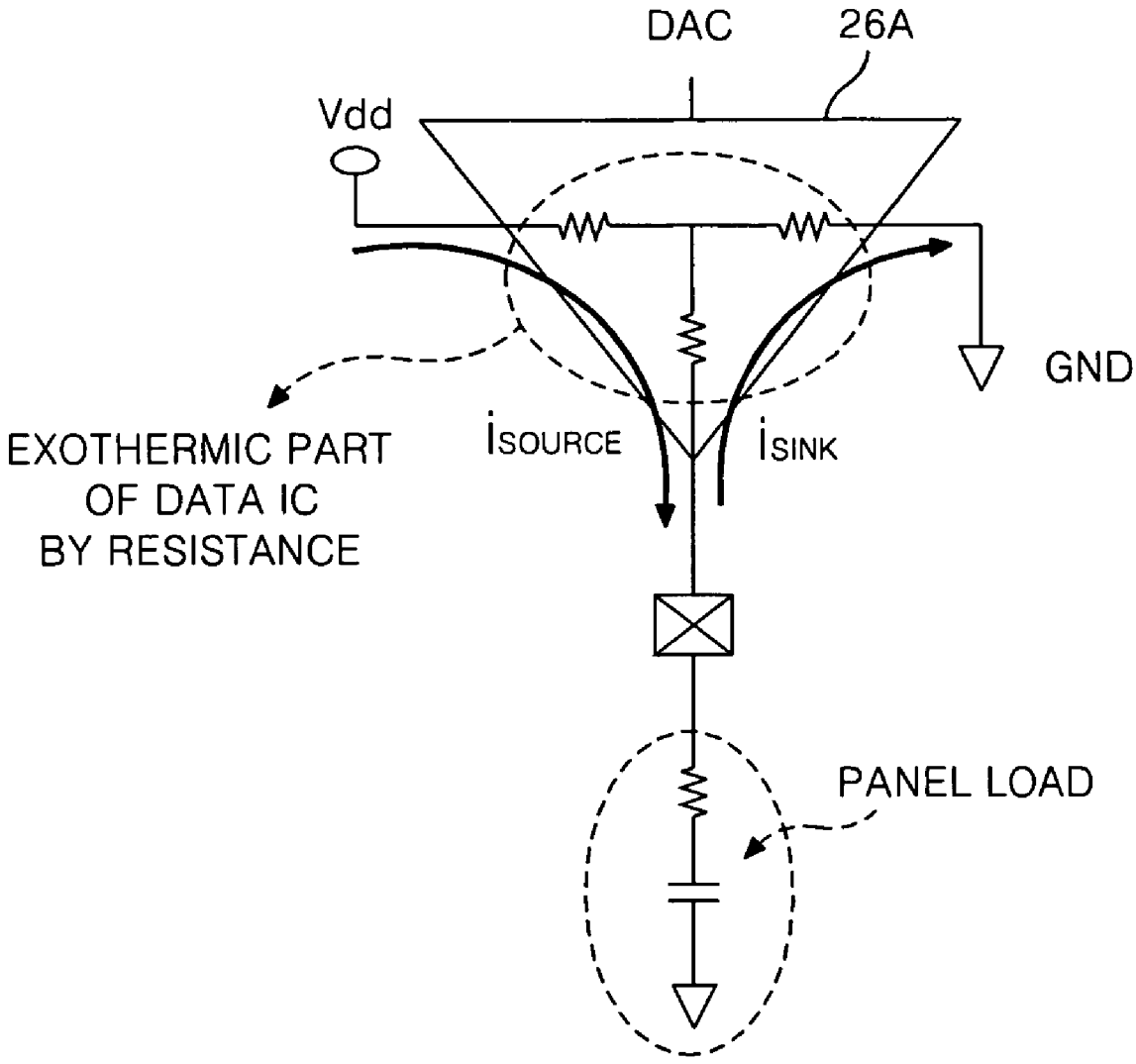
FIG. 3 RELATED ART
FIG. 3 is a circuit diagram representing the internal resistive components that may be associated with an output buffer and the corresponding current flowing through the components.
Figure 4:
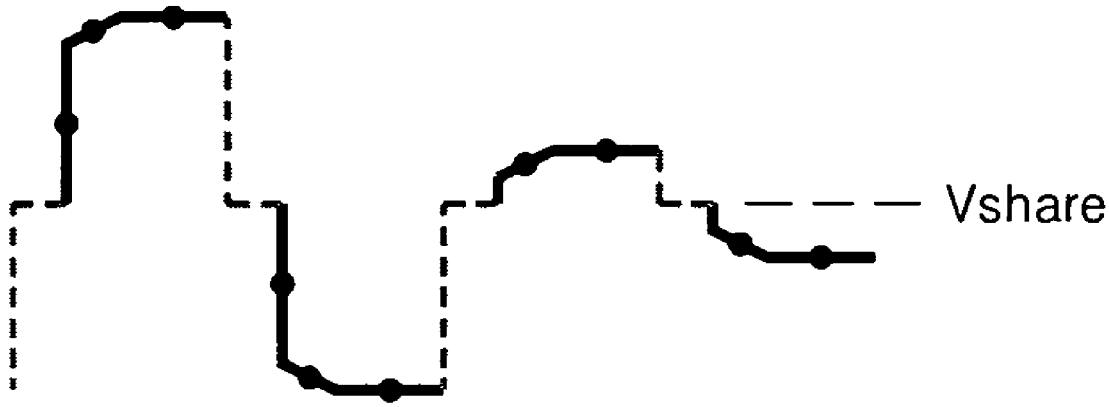
FIG. 4 RELATED ART
FIG. 4 is an exemplary waveform that may be provided at a data line using a charge share method for driving the liquid crystal display.
Figure 5:
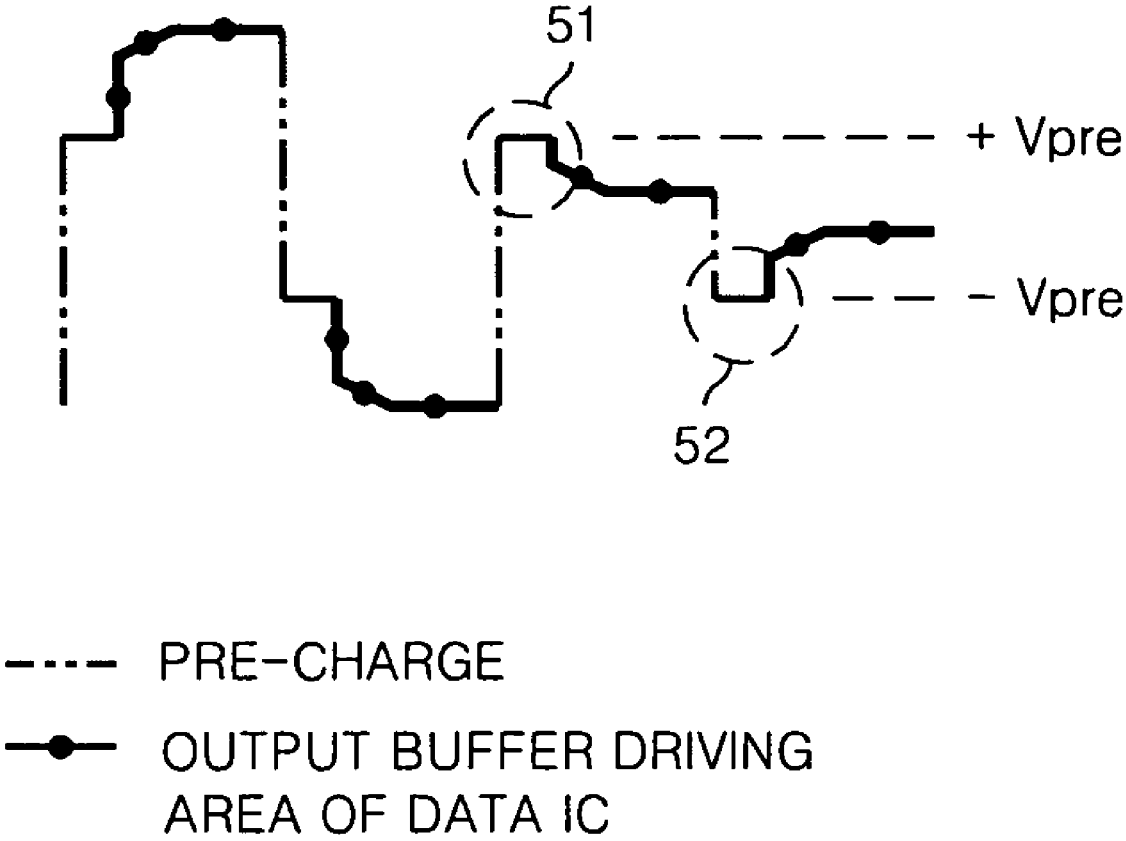
FIG. 5 RELATED ART
FIG. 5 is an exemplary waveform that may be provided at a data line using a pre-charge method for driving the liquid crystal display.

Referring to FIGS. 6 and 7, the exemplary data IC of the liquid crystal display device includes a data register 61, a latch 62, a comparator 63, a DAC 64, an output buffer 65, a de-multiplexer (hereinafter, referred to as "DMUX") 66, an OR gate 67, and transistors pT, nT1, nT2, nT3. As shown in FIG. 7, the first source output enable signal SOE1 is employed as a control signal which provides a charge share voltage V-Share at the corresponding data line. A second source output enable signal SOE2 is employed as a control signal that is used to provide one of a plurality of pre-charge voltages at the corresponding data line. In the illustrated example, two pre-charge voltage levels are used V-POS, V-NEG. The second source output enable signal SOE2 is shifted in time by one pulse width with respect to the first source output enable signal SOE1. The source output enable signals SOE1, SOE2 are each generated during one horizontal period interval. The polarity control signal POL has its logic value inverted for each horizontal interval to control the polarity of the data voltage supplied to the data lines of the liquid crystal display panel. The source output enable signals SOE1, SOE2 and the polarity control signal POL may be generated, for example, in a timing controller 1 of the type shown in FIG. 1.

The data register 61 receives digital video data from the timing controller and provides it to the input of latch 62. The latch 62 temporarily stores the digital video data received from the data register 61 in response to one or more sampling signals provided by, for example, a shift register (not shown in FIG. 6). The latch 62 provides the digital video data in a generally concurrent manner to both the DAC 64 and the comparator 63. The DAC 64, in turn, converts the digital video data received from the latch 62 into an analog gamma voltage that may be used as the pixel drive voltage at the corresponding drive line. The output buffer 65 supplies the analog voltage from the DAC 64 to a drain terminal of a p-type transistor PT. The OR gate 67 performs a logical operation on the first source output enable signal SOE1 and the second source output enable signal SOE2 to generate an output signal to the gate of the p-type transistor PT. As such, the output signal of the OR gate 67 is used to control the conductive state of the p-type transistor PT. In the illustrated example, the p-type transistor PT is turned on when an output of the OR gate 67 is at a low logic level. When this occurs, the pixel drive voltage from the output buffer 65 is provided to the corresponding data line of the liquid crystal display panel.

The comparator 63 receives the digital video data from the latch 62 to determine, for example, the gray level value that will be used as the pixel drive voltage. Based on this determination, the comparator 63 provides one or more output signals to control the DMUX 66 in accordance with the digital video data values. More particularly, the comparator 63 may generate an output signal at a first logic level when the magnitude of the digital video data received from latch 62 is above a first predetermined threshold value. The comparator 63 may generate an output signal at a second logic level when the magnitude of the digital video data received from latch 62 is below a second predetermined threshold value. The first predetermined threshold value is different from the second predetermined threshold value. For example, the comparator 63 may generate a high logic level signal at its output when the magnitude of the digital video data, as indicated by the value of the data received from latch 62, is high, e.g., at a white gray level voltage or a voltage close thereto in a normally white mode. Similarly, the comparator 63 may generate an output signal at a low logic level when the magnitude of the digital video data, as indicated by the value of the data received from latch 62, is relatively low, e.g., at a black gray level voltage or a voltage close thereto in the normally black mode.

Whether the magnitude of the digital video data is high (i.e., at and/or above a first predetermined threshold value) or low (i.e., at and/or below a second predetermined threshold value) may be determined in a number of different manners. In the following example, it is assumed that the digital video data includes 8 bits so that the number of expressible gray levels is 256. In such a system, the digital video data may be considered high when it has a magnitude at or exceeding a level corresponding to 127, a magnitude at or above 160, a magnitude at or above 191, or a magnitude at or above 224. Similarly, a digital video data level may be considered relatively low when it has a magnitude at or below 127, a magnitude at or below 160, a magnitude at or below 191, or a magnitude at or below 224.

Figure 8:
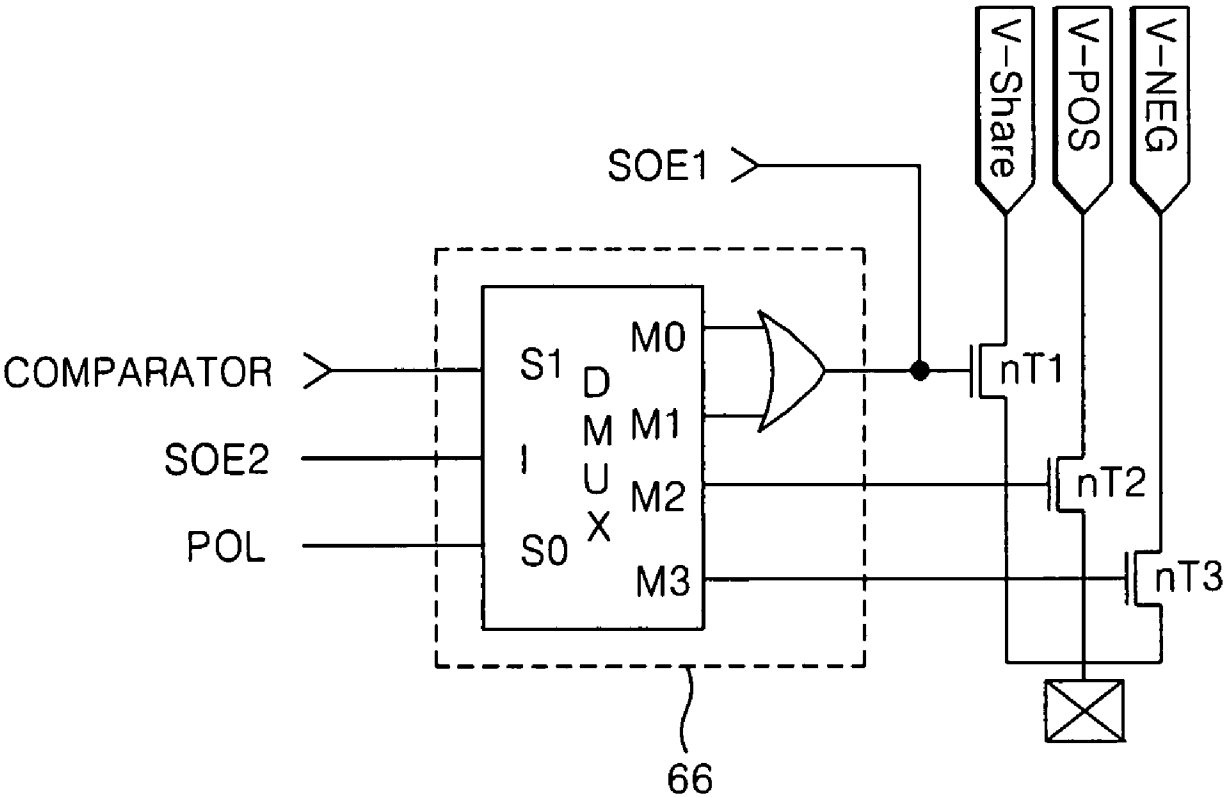
FIG. 8 is a schematic block diagram of one embodiment of a de-multiplexer and corresponding truth table that may be used in the system shown in FIG. 6.
Figure 9:
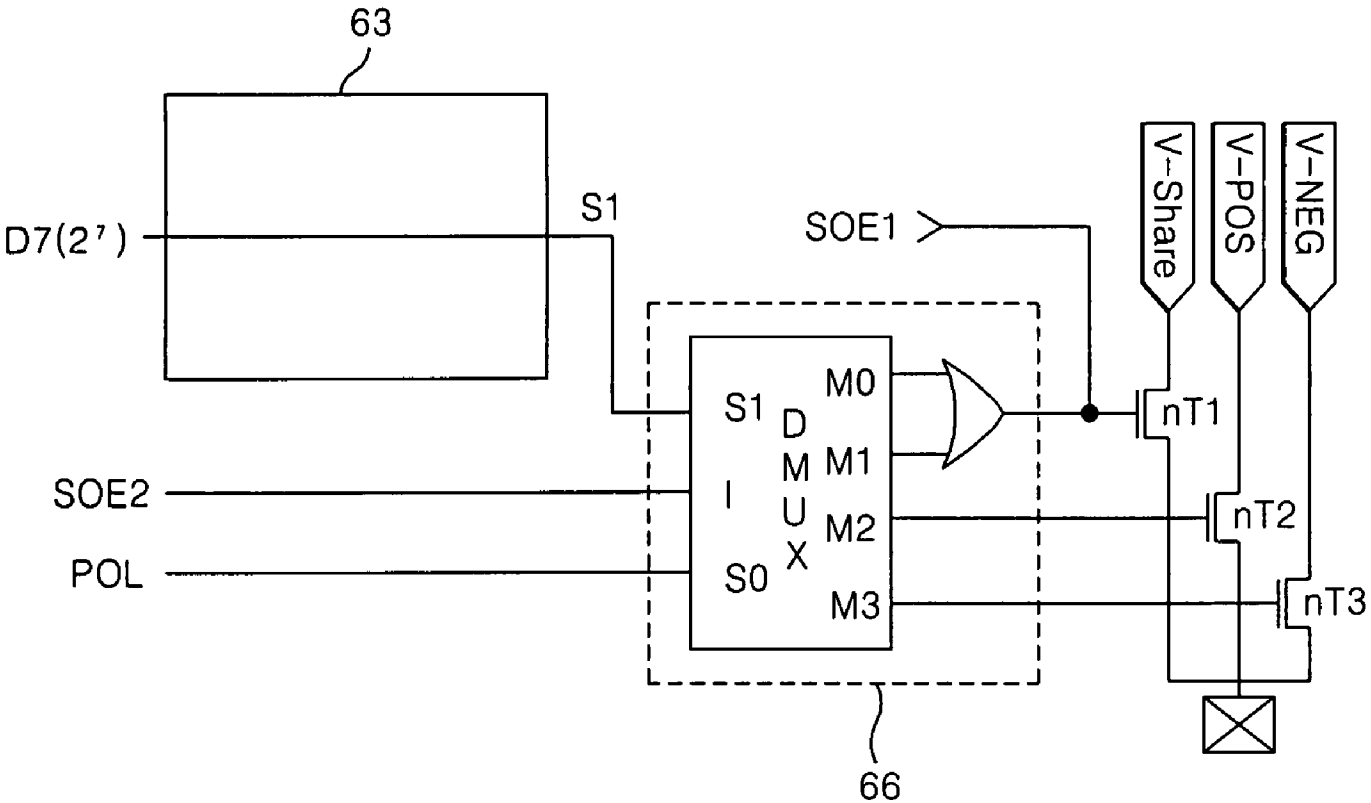
FIG. 9 is a schematic block diagram of a first embodiment of a comparator that may be used in the system shown in FIG. 6.

One embodiment of the DMUX 66 is shown in FIG. 8. As illustrated, DMUX 66 outputs the logical state of the source output enable signal SOE2 to any one of a plurality of output terminals M0 to M3 in accordance with the output signal of the comparator 63 and the logical state of the polarity control signal POL. The states of the output signals at M0 through M3, in turn, are ultimately used to drive the gates of transistors nT1, nT2, and nT3, in, for example, a mutually exclusive manner.

As shown in FIG. 8, the OR gate is connected to the first and second output terminal M0, M1 of the DMUX 66, and the output terminal of the OR gate is connected to the gate terminal of the first n-type transistor nT1. The DMUX 66, as shown in the truth table of FIG. 8, operates to provide the logical state of the second source output enable signal SOE2 to the gate terminal of the first n-type transistor nT1 through the OR gate when the output signal from the comparator 63 is at a low logic level, i.e., when the magnitude of the digital video data is a low. Consequently, when SOE2 is at a high logic level, a drive signal is provided to the gate of transistor nT1 thereby connecting the voltage V-Share to the output of the data line. The voltage level of the charge share voltage, V-Share, is between pre-charge voltages V-POS, V-NEG. The charge share voltage V-Share is provided at the data line irrespective of the logic value of the polarity control signal POL.

The DMUX 66 supplies the logical state of SOE2 to the gate terminal of the second n-type transistor nT2 when the output signal of comparator 63 is at a logical high level and the signal of the polarity control signal POL is at a low logic level. This occurs when the magnitude of the digital video data is high. In this state, a logic high signal is provided at output M2 of DMUX 66 to drive the gate of transistor nT2 when SOE2 goes to a logical high state, thereby supplying a positive pre-charge voltage V-POS to the corresponding data line of the liquid crystal display panel. Further, the DMUX 66 supplies the logical state of SOE2 to a gate terminal of a third n-type transistor nT3 when the output signal of comparator 63 and the output of the polarity control signal POL are at logical high levels. In this state, a logic high signal is provided at output M3 of DMUX 66 to drive the gate of transistor nT3 when SOE2 goes to a logical high state, thereby providing a negative pre-charge voltage V-NEG to the corresponding data line of the liquid crystal display panel. The DMUX 66, the transistors PT, nT1, nT2, nT3 and the control/driving signals POL, SOE1, SOE2, V-Share, V-POS, V-NEG thus cooperate to act as a pre-charge controller that controls the pre-charging of the corresponding data line.

The first source output enable signal SOE1 is supplied to the gate terminal of the first n-type transistor nT1 prior to the second source output enable signal SOE. As a result, the data line is pre-charged at the charge share voltage V-Share prior to any transition to another pre-charge voltage V-POS, V-NEG. This occurs even when the data voltage level is determined by the comparator 63 to be at a high level.

A single voltage can be generated in a power supply circuit that is either interior to or exterior to the data IC. This single voltage can be divided into three or more voltage levels within a predetermined voltage range to generate the charge share voltage V-Share, the positive pre-charge voltage V-POS, and the negative pre-charge voltage V-NEG.

FIGS. 9 through 12 are schematic block diagrams showing various embodiments of the comparator 63. In accordance with the first embodiment shown in FIG. 9, the comparator 63 receives the seventh bit D7 of the output of latch 62. Bit D7 has a bit weight value "$2^7$" and is generated as a high logic level signal when the magnitude of the digital video data exceeds 128 and has a low logic level signal when the magnitude of the digital video data is at or lower than 128. The signal on bit D7 is provided to an input terminal S1 of the DMUX 66. Accordingly, the comparator 63 of the embodiment may be realized by merely supplying the D7 bit to the DMUX 66. The D7 bit may be directly connected to the DMUX 66, or it may be provided to the DMUX 66 through one or more intermediate buffers drivers. When the comparator 63 is implemented in this manner, the load on the data IC is reduced by charging the data line with the high magnitude pre-charge voltages V-POS, V-NEG when the magnitude of the digital video data is at or exceeds, for example, 128, and by charging the data line solely with the low magnitude charge share voltage V-share if the magnitude of the digital video data is less than 128.

Figure 10:
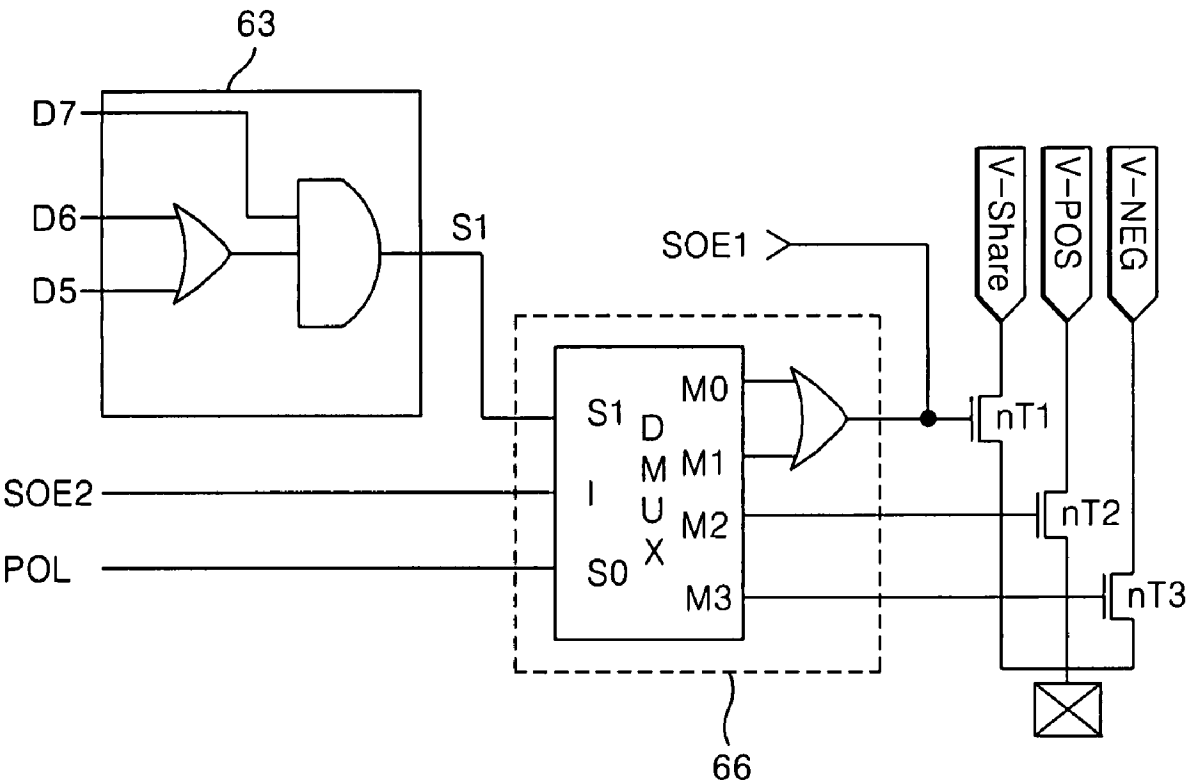
FIG. 10 is a schematic block diagram of a second embodiment of a comparator and corresponding truth table that may be used in the system shown in FIG. 6.

A second embodiment of a comparator 63 is shown in FIG. 10. In this embodiment, an OR gate executes a logical summing operation using the D6 bit of a weight value "$2^6$" and the D5 bit of a weight value "$2^5$" as the operands. Further, an AND gate executes a logical multiplication operation using the output of the OR gate and the D7 bit as the operands. The output of the AND gate is provided to the input S1 of the DMUX 66 and constitutes the output of the comparator 63. The output of the comparator 63 is driven to a high logic level when the magnitude of the digital video data is at or exceeds 160 and has a low logic level when the magnitude of the digital video is less than 160. Accordingly, the comparator 63 of this embodiment is realized using two logic gate devices. When the comparator 63 is implemented in this manner, the load on the data IC is reduced by charging the data line with the high magnitude pre-charge voltages V-POS, V-NEG when the magnitude of the digital video data is at or exceeds, for example, 160, and by charging the data line solely with the low magnitude charge share voltage V-Share if the magnitude of the digital video data is less than 160.

Figure 11:
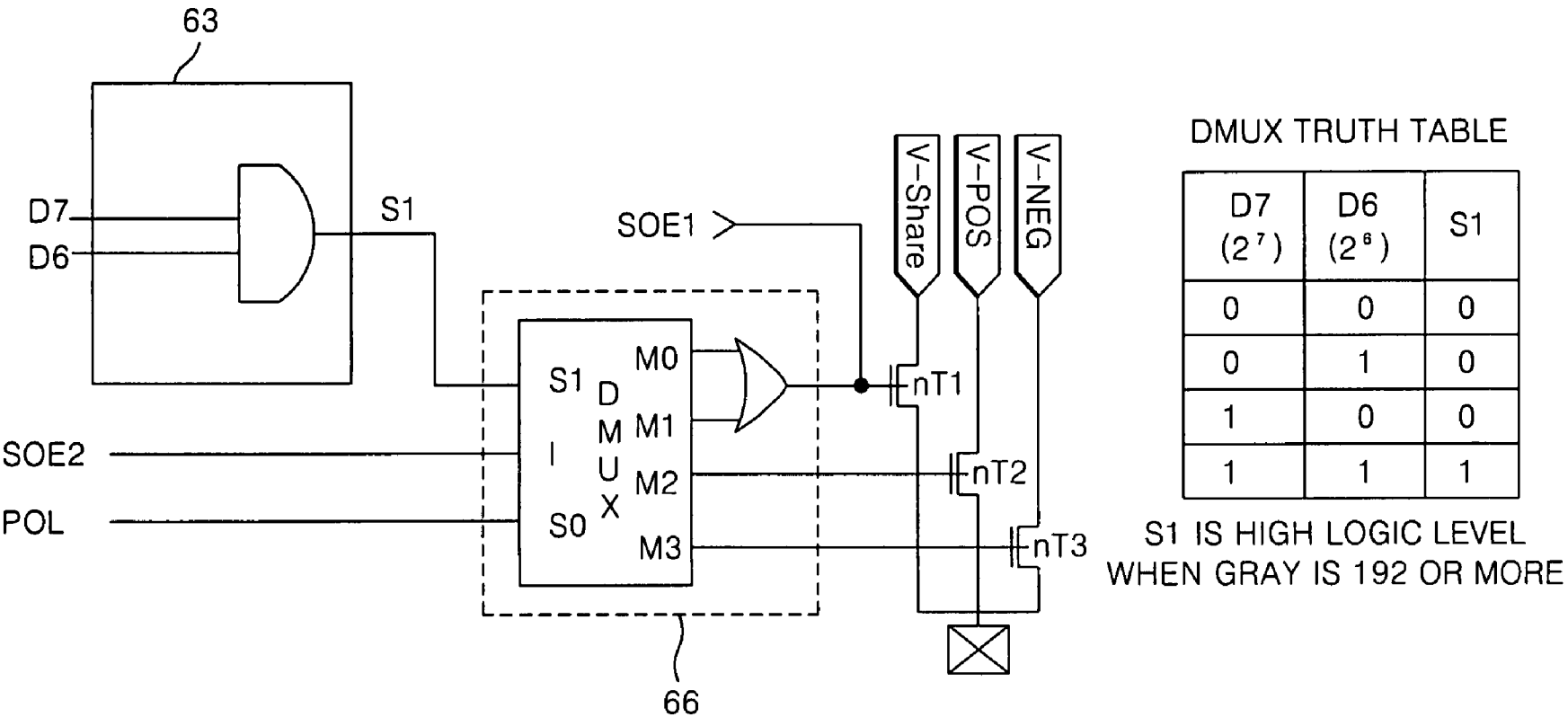
FIG. 11 is a schematic block diagram of a third embodiment of a comparator and corresponding truth table that may be used in the system shown in FIG. 6.

A third embodiment of the comparator 63 is shown in FIG. 11. This embodiment of the comparator 63 includes an AND gate executes a logical multiplication operation using the D6 bit of a weight value "$2^6$" and the D7 bit of a weight value "$2^7$". As a result, the output of the AND gate (and, thus, the comparator 63) is driven to a high logic value when the magnitude of the digital video data is at or exceeds 192, and is driven to a low logic value when the magnitude of the digital video data is less than 192. Accordingly, the comparator 63 of this embodiment may be realized using a single logic gate device. When the comparator 63 is implemented in this manner, the load on the data IC is reduced by charging the data line with the high magnitude pre-charge V-POS, V-NEG when the magnitude of the digital video data is at or exceeds, for example, 192, and by charging the data line solely with the low magnitude charge share voltage V-Share if the magnitude of the digital video data is less than 192.

Figure 12:
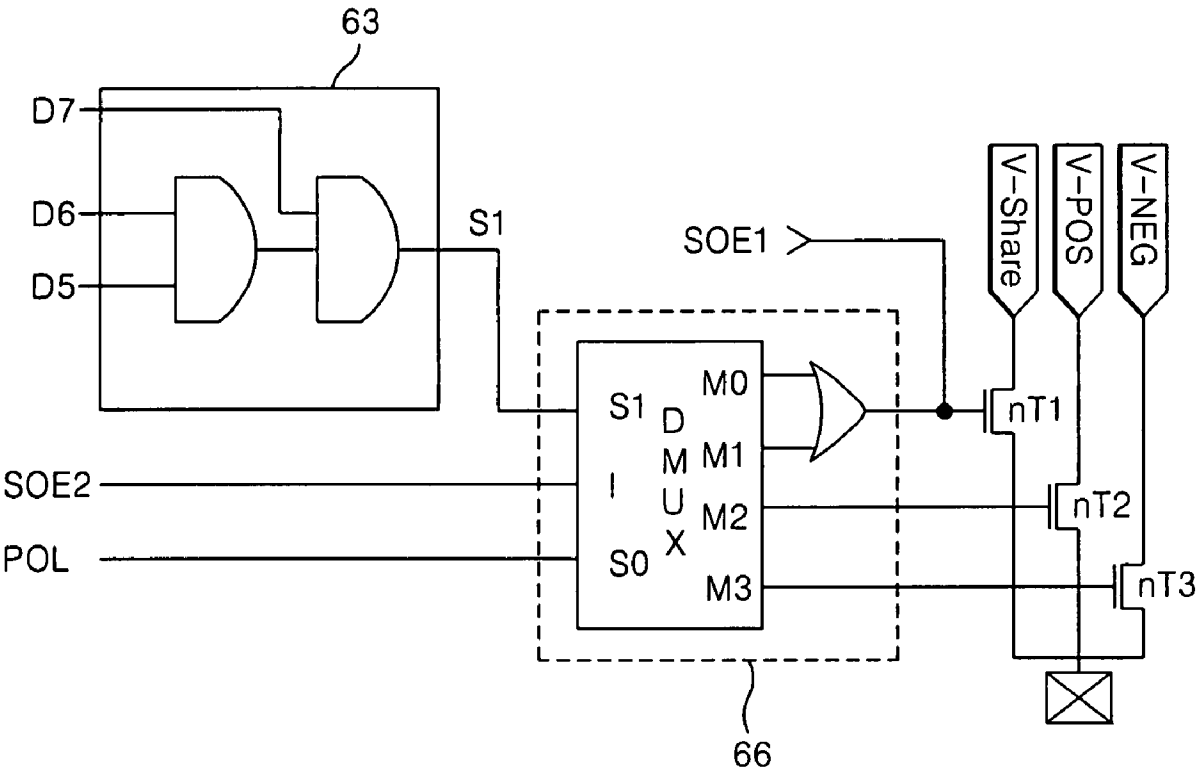
FIG. 12 is a schematic block diagram representing a fourth embodiment of a comparator and corresponding truth table that may be used in the system shown in FIG. 6.

A fourth embodiment of the comparator 63 is shown in FIG. 12. In this embodiment, a first AND gate executes a logical multiplication operation using the D6 bit of a weight value "$2^6$" and the D5 bit of a weight value "$2^5$" as operands. A second AND gate is used to execute a logical multiplication operation using the output of the first AND gate and the D7 bit of a weight value "$2^7$" as the operands. The output signal of the second AND gate is used as the output of the comparator 63 and is provided to the input S1 of DMUX 66. As a result, input signal S1 is driven to a high logic when the magnitude of the digital video data is at or exceeds 224, and is driven to a low logic level when the magnitude of the digital video data is less than 224. Accordingly, the comparator 63 of this embodiment may be realized using two logic gate devices. When the comparator 63 is implemented in this manner, the load on the data IC is reduced by charging the data line with the high magnitude pre-charge V-POS, V-NEG when the magnitude of the digital video data is at or exceeds, for example, 224, and by charging the data line solely with the low magnitude charge share voltage V-Share if the magnitude of the digital video data is less than 224.

Operation of the exemplary system shown in FIG. 6 may be explained in connection with the provision of a plurality of 8-bit data voltage values that are sequentially supplied to the system as, for example, the RGB data values. If the first digital video data value is at the 256th gray level (1111 1111), the output of the comparator 63 is driven to a high logic level. With the comparator output in this state, the first data line of the liquid crystal display panel is pre-charged with the charge share voltage V-Share when signal SOE1 and signal POL are driven to a high logic level. Signal SOE1, as shown in FIG. 7, then goes to a low logic level after a predetermined time period thereby causing the first data line to charge to the positive pre-charge voltage V-POS. Signal SOE2 then goes to a logical low level, which drives transistor PT to a conductive state thereby providing the signal from output buffer 65 at the first data line. The voltage of the signal at the first data line corresponds to the voltage needed to drive the corresponding liquid crystal cell to the 256th gray level.

For descriptive purposes, it is assumed that the second data voltage value in the sequence is equal to the first digital video data value, i.e., (1111 1111). When signal SOE1 goes to a high logic level, the corresponding data line is driven to the charge share voltage V-Share. During this second scan, the polarity control signal POL changes, inverting from its prior logic state. Since signal POL was at a high logic level during the first scan, it is driven to a low logic level during the second scan so that the first data line is ultimately pre-charged to the negative pre-charge voltage V-NEG when signal SOE1 returns to a low logic level. Signal SOE2 then goes to a logical low level, which drives transistor PT to a conductive state thereby providing the signal from output buffer 65 at the first data line. The voltage of the signal at the first data line corresponds to the voltage needed to drive the corresponding liquid crystal cell to the 256th gray level, but has been inverted during this scan.

It is now assumed that the third and fourth digital video data values in the sequence are equal to a gray level of 63 (0011 1111). As such, the output of the comparator 63 is driven to a low logic level. Before the voltage corresponding to a gray level of 63 is provided on the first data line of the liquid crystal display panel, the first data line is pre-charged with the charge-share voltage V-share for a duration approximately equal to the combined pulse widths of signals SOE1 and SOE2. Once signal SOE2 goes to a logical low level, transistor PT is driven to a conductive state thereby providing the signal from output buffer 65 at the first data line. The voltage of the signal that is now presented at the first data line corresponds to the voltage needed to drive the corresponding liquid crystal cell to the 63rd gray level. Since signal POL is at a high logic levels during this end, the voltage provided at the first data line is not inverted. During the subsequent scan, the first data line is again pre-charged to the value of V-Share before being driven to the voltage corresponding to the 63rd gray level. However, signal POL is in a logic low state during this scan and the resulting voltage corresponding to the 63rd gray level is inverted.

Figure 13:
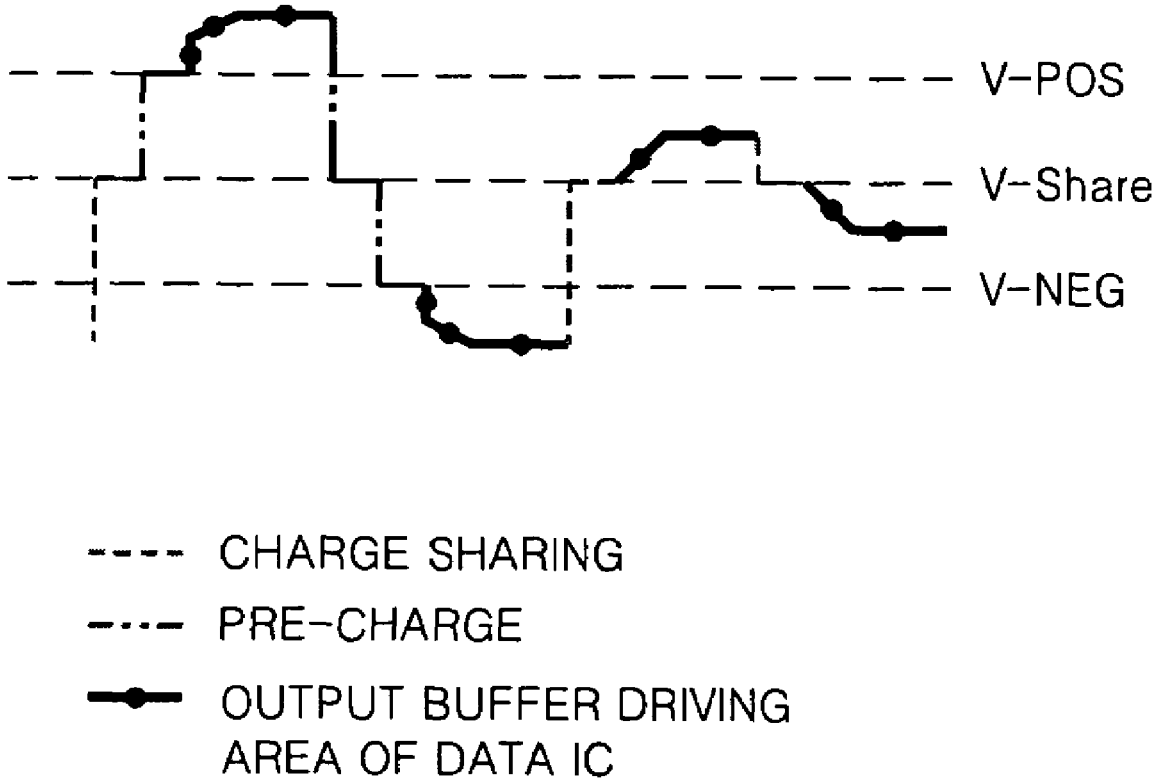
FIG. 13 is an exemplary waveform that may be generated at a data line using the system shown in FIG. 6.

FIG. 13 represents an output waveform of the data IC 3A using the same sequence of digital video data levels that are described above. As shown, the data IC 3A first pre-charges the data line to the charge share voltage level V-Share. If the next digital video data level in the digital video data sequence is below a predetermined threshold value, the pre-charge remains at the V-Share level until the pixel drive voltage is provided from the output buffer on the data line. However, if the next digital video data level in the digital video data sequence is at or above the predetermined threshold value, the data line is further pre-charged to either V-POS or V-NEG until the pixel drive voltage is provided from the output buffer at the data line. Whether the data line is pre-charged to V-POS or V-NEG is dependent on the logic state of signal POL, which inverts its logic state from scan-to-scan. By pre-charging the data line in the foregoing manner, the overall current that must flow through the operational section of the output buffer may be substantially reduced. This reduction in current flow, in turn, results in a corresponding reduction in the heat dissipation requirements for the output buffer and increases its reliability.

In the foregoing embodiment, the liquid crystal display device and the driving method thereof various circuits are used to pre-charge a data line before a gray level voltage is provided from an output buffer to the data line. The pre-charge voltage and/or pre-charge voltage sequence may be dependent on the magnitude of the data voltage level that will be used to provide the next gray level voltage that is connected to the data line.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device comprising:

a data line connected to drive a liquid crystal cell;

an output driver connected to selectively provide a pixel drive signal to the data line, where the pixel drive signal corresponds to a video data signal provided to the liquid crystal display device;

a pre-charging circuit connected to selectively pre-charge the data line to one or more of a plurality of voltage levels depending on the value of the video data signal, wherein the pre-charging circuit comprises:

a comparator providing an output signal indicative of whether a digital video data signal has a value at or above or below a predetermined threshold; and a pre-charge controller operating to initially pre-charge a data line of a liquid crystal cell to a charge share voltage, the pre-charge controller further operating to initiate a second pre-charge of the data line with a further pre-charge voltage depending on the output signal of the comparator, wherein the further pre-charge voltage has a magnitude greater than the magnitude of the charge share voltage, and wherein the pre-charge controller comprises:

a plurality of input lines for receiving a first source output enable signal, a second source output enable signal having a later phase than the first source output enable signal, and a polarity control signal for controlling a polarity of the data;

a demultiplexer which outputs the second source output enable signal to any one of a plurality of output terminals in accordance with an output of the comparator and an output of the polarity control signal;

a first transistor responsive to an active state of an output of the demultiplexer or an active state of the first source output enable signal for supplying the charge share voltage to the data line;

a second transistor responsive to an output of the demultiplexer for supplying a positive pre-charge voltage if the value of the digital video data signal is at or above the predetermined threshold value and the polarity control signal directs a positive voltage output state; and a third transistor responsive to an output of the demultiplexer for supplying a negative pre-charge voltage to the data line in if the value of the digital video data signal is below the predetermined threshold value and the polarity control signal directs a negative voltage output.

2. The liquid crystal display device of claim 1, where the plurality of voltage levels comprises a positive pre-charge voltage, a negative pre-charge voltage, and a charge share voltage, and where the magnitudes of the positive pre-charge voltage and the negative pre-charge voltage are greater than the magnitude of the charge share voltage.

3. The liquid crystal display device of claim 1, where the plurality of voltage levels comprises a positive pre-charge voltage, a negative pre-charge voltage, and a charge share voltage, and where the charge share voltage is at a voltage level between the positive pre-charge voltage and the negative pre-charge voltage.

4. A liquid crystal display device, comprising:

a comparator providing an output signal indicative of whether a digital video data signal has a value at or above or below a predetermined threshold; and a pre-charge controller operating to initially pre-charge a data line of a liquid crystal cell to a charge share voltage, the pre-charge controller further operating to initiate a second pre-charge of the data line with a further pre-charge voltage depending on the output signal of the comparator, wherein the further pre-charge voltage has a magnitude greater than the magnitude of the charge share voltage, and wherein the pre-charge controller comprises:

a plurality of input lines for receiving a first source output enable signal, a second source output enable signal having a later phase than the first source output enable signal, and a polarity control signal for controlling a polarity of the data;

a demultiplexer which outputs the second source output enable signal to any one of a plurality of output terminals in accordance with an output of the comparator and an output of the polarity control signal;

a first transistor responsive to an active state of an output of the demultiplexer or an active state of the first source output enable signal for supplying the charge share voltage to the data line;

a second transistor responsive to an output of the demultiplexer for supplying a positive pre-charge voltage if the value of the digital video data signal is at or above the predetermined threshold value and the polarity control signal directs a positive voltage output state; and a third transistor responsive to an output of the demultiplexer for supplying a negative pre-charge voltage to the data line in if the value of the digital video data signal is below the predetermined threshold value and the polarity control signal directs a negative voltage output.

5. The liquid crystal display device of claim 4, where the pre-charge controller operates to initiate the second pre-charge of the data line when the output signal of the comparator indicates that the digital video data signal is at or above the predetermined threshold value.

6. The liquid crystal display device of claim 4, where the comparator and the pre-charge controller are embedded within a monolithic integrated circuit.

7. The liquid crystal display device according to claim 4, where the comparator comprises:

a signal wire line for supplying any one of a plurality of bits of the digital video data signal to the demultiplexer.

8. The liquid crystal display device according to claim 4, where the comparator comprises one or more logic gate devices for executing a logical sum operation to or more bits of the digital video data signal.

9. The liquid crystal display device according to claim 8, where the comparator comprises:

an OR gate for performing a logical sum operation on a first upper bit of a weight value "2.sup.5" and a second upper bit of a weight value "2.sup.6" of the digital video data signal; and an AND gate for performing a logical multiply operation on an output of the OR gate and a third upper bit of a weight value "2.sup.7" of the digital video data signal.

10. The liquid crystal display device according to claim 8, where the comparator comprises:

an AND gate for performing a logical multiply operation on a first upper bit of a weight value "2.sup.6" and a second upper bit of a weight value "2.sup.7" of the digital video data signal.

11. The liquid crystal display device according to claim 8, where the comparator comprises:

a first AND gate for performing a logical multiply operation on a first upper bit of a weight value "2.sup.5" and a second upper bit of a weight value "2.sup.6" of the digital video data signal; and a second AND gate for performing a logical multiply operation on an output of the first AND gate and a third upper bit of a weight value "2.sup.7" of the digital video data signal.

12. The liquid crystal display device according to claim 4, where the predetermined threshold value corresponds to any one of a gray voltage level of 128 or more, a gray voltage level of 160 or more, a gray voltage level of 192 or more, and a gray voltage level of 224 or more.

13. A method of driving a liquid crystal display device comprising:

comparing the value of a digital video data signal to a predetermined threshold value; and pre-charging a data line of a liquid crystal cell to one of a plurality of different voltage levels based on the comparison;

using the digital video data signal to generate a pixel drive voltage on the data line of the liquid crystal cell, wherein a pre-charging circuit for pre-charging the data line of the liquid crystal cell comprises:

a comparator providing an output signal indicative of whether a digital video data signal has a value at or above or below a predetermined threshold; and a pre-charge controller operating to initially pre-charge a data line of a liquid crystal cell to a charge share voltage, the pre-charge controller further operating to initiate a second pre-charge of the data line with a further pre-charge voltage depending on the output signal of the comparator, wherein the further pre-charge voltage has a magnitude greater than the magnitude of the charge share voltage, and wherein the pre-charge controller comprises:

a plurality of input lines for receiving a first source output enable signal, a second source output enable signal having a later phase than the first source output enable signal, and a polarity control signal for controlling a polarity of the data;

a demultiplexer which outputs the second source output enable signal to any one of a plurality of output terminals in accordance with an output of the comparator and an output of the polarity control signal;

a first transistor responsive to an active state of an output of the demultiplexer or an active state of the first source output enable signal for supplying the charge share voltage to the data line;

a second transistor responsive to an output of the demultiplexer for supplying a positive pre-charge voltage if the value of the digital video data signal is at or above the predetermined threshold value and the polarity control signal directs a positive voltage output state; and a third transistor responsive to an output of the demultiplexer for supplying a negative pre-charge voltage to the data line in if the value of the digital video data signal is below the predetermined threshold value and the polarity control signal directs a negative voltage output.

14. A method of driving a liquid crystal display device comprising:

receiving a digital video data signal;

pre-charging a data line of a liquid crystal cell to a charge share voltage;

further pre-charging the data line to a further pre-charge voltage if the value of the digital video data signal exceeds a predetermined threshold value; and using the digital video data signal to generate a pixel drive voltage on the data line of the liquid crystal cell, wherein a pre-charging circuit for pre-charging the data line of the liquid crystal cell comprises:

a comparator providing an output signal indicative of whether a digital video data signal has a value at or above or below a predetermined threshold; and a pre-charge controller operating to initially pre-charge a data line of a liquid crystal cell to a charge share voltage, the pre-charge controller further operating to initiate a second pre-charge of the data line with a further pre-charge voltage depending on the output signal of the comparator, wherein the further pre-charge voltage has a magnitude greater than the magnitude of the charge share voltage, and wherein the pre-charge controller comprises:

a plurality of input lines for receiving a first source output enable signal, a second source output enable signal having a later phase than the first source output enable signal, and a polarity control signal for controlling a polarity of the data;

a demultiplexer which outputs the second source output enable signal to any one of a plurality of output terminals in accordance with an output of the comparator and an output of the polarity control signal;

a first transistor responsive to an active state of an output of the demultiplexer or an active state of the first source output enable signal for supplying the charge share voltage to the data line;

a second transistor responsive to an output of the demultiplexer for supplying a positive pre-charge voltage if the value of the digital video data signal is at or above the predetermined threshold value and the polarity control signal directs a positive voltage output state; and a third transistor responsive to an output of the demultiplexer for supplying a negative pre-charge voltage to the data line in if the value of the digital video data signal is below the predetermined threshold value and the polarity control signal directs a negative voltage output.

15. The method of claim 14 where the further pre-charge voltage has a magnitude that is larger than the magnitude of the charge share voltage.

* * * * *